US007515844B2

(12) United States Patent
Tanaka et al.

(10) Patent No.: US 7,515,844 B2
(45) Date of Patent: Apr. 7, 2009

(54) IMAGE DENSITY CONTROL METHOD AND IMAGE FORMING APPARATUS

(75) Inventors: Kayoko Tanaka, Tokyo (JP); Kohta Fujimori, Kanagawa (JP); Yuji Hirayama, Kanagawa (JP); Nobutaka Takeuchi, Kanagawa (JP); Shin Hasegawa, Kanagawa (JP); Shinji Kato, Kanagawa (JP); Takashi Enami, Kanagawa (JP); Kazumi Kobayashi, Tokyo (JP); Kiichirou Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 11/561,053

(22) Filed: Nov. 17, 2006

(65) Prior Publication Data

US 2007/0122168 A1 May 31, 2007

(30) Foreign Application Priority Data

Nov. 30, 2005 (JP) ..... 2005-345767

(51) Int. Cl.
*G03G 15/10* (2006.01)
*G03G 15/08* (2006.01)

(52) U.S. Cl. ..... 399/59; 399/27

(58) Field of Classification Search ..... 399/27, 399/30, 49, 58, 59, 60, 61
See application file for complete search history.

(56) References Cited

U.S. PATENT DOCUMENTS 5,387,965 A * 2/1995 Hasegawa et al. ..... 399/60
5,493,382 A 2/1996 Takagaki et al.
5,604,575 A 2/1997 Takagaki et al.
5,737,680 A 4/1998 Takagaki et al.
6,987,934 B2 * 1/2006 Bessho et al. ..... 399/27

FOREIGN PATENT DOCUMENTS

JP 57-136667 8/1982
JP 2-34877 2/1990
JP 7-234582 9/1995

OTHER PUBLICATIONS

U.S. Appl. No. 11/856,304, filed Sep. 17, 2007, Oshige, et al.
U.S. Appl. No. 11/932,198, filed Oct. 31, 2007, Takeuchi, et al.
U.S. Appl. No. 07/811,056, filed Dec. 20, 1991, Yuko Harasawa, et al.
U.S. Appl. No. 12/112,525, filed Apr. 30, 2008, Koizumi, et al.
U.S. Appl. No. 12/093,753, filed May 15, 2008, Oshige et al.
U.S. Appl. No. 12/094,198, filed May 19, 2008, Kato et al.

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image density control method for an image forming apparatus in which, in order to keep the development capability constant over time, the toner density in the developer is manipulated to an appropriate range by changing the toner density control reference value in accordance with the toner replacement amount in a fixed time period by ascertaining changes in the image coverage of the output images, and by changing the image forming conditions at predetermined execution intervals.

14 Claims, 11 Drawing Sheets

FIG. 7

| IMAGE COVERAGE RATIO CUMULATIVE AVERAGE VALUE [%] | ΔTC[wt%] | ΔVtref[V] |
|---|---|---|
| Mi<1 | 0.5 | -0.15 |
| 1≦Mi<2 | 0.4 | -0.12 |
| 2≦Mi<3 | 0.3 | -0.09 |
| 3≦Mi<4 | 0.2 | -0.06 |
| 4≦Mi<6 | 0 | 0.00 |
| 6≦Mi<7 | -0.1 | 0.03 |
| 7≦Mi<8 | -0.2 | 0.06 |
| 8≦Mi<9 | -0.3 | 0.09 |
| 9≦Mi<10 | -0.4 | 0.12 |
| 10≦Mi<20 | -0.5 | 0.15 |
| 20≦Mi<30 | -0.6 | 0.18 |
| 30≦Mi<40 | -0.7 | 0.21 |
| 40≦Mi<50 | -0.8 | 0.24 |
| 50≦Mi<60 | -0.9 | 0.27 |
| 60≦Mi<70 | -1.0 | 0.30 |
| 70≦Mi<80 | -1.0 | 0.30 |
| 80≦Mi | -1.0 | 0.30 |

FIG. 10

| PROCESS CONTROL | IMAGE COVERAGE RATIO CUMULATIVE AVERAGE $S \geqq 20$ | IMAGE COVERAGE RATIO CUMULATIVE AVERAGE $S < 20$ |
|---|---|---|
| POWER SOURCE ON | CONDITION 1 | CONDITION 1 |
| FRONT COVER CLOSED | CONDITION 1 | CONDITION 1 |
| ENERGY SAVING MODE REVERSION | CONDITION 1 | CONDITION 1 |
| INTERRUPTION | CONDITION 2 | CONDITION 1 |
| JOB END | CONDITION 2 | CONDITION 1 |

IMAGE DENSITY CONTROL METHOD AND IMAGE FORMING APPARATUS

BACKGROUND OF THE INVENTION

1. Field of the Invention

The present invention relates to an image density control method for an electrophotographic type image forming apparatus such as a copier, printer or facsimile device.

2. Description of the Related Art

The demand for improved copier and laser printer image quality in recent years has been simultaneously accompanied by a desire for improved image durability and stability. In other words, there is a need for images that are minimally affected by change when in use (including continuous printing and intermittent printing) and that remain stable over time to be provided. Two-component developer systems in which a two-component developer comprising a non-magnetic toner and magnetic carrier (hereinafter referred to as a developer) that is held on a developer carrier (hereinafter referred to as a development sleeve), and in which development is based on a magnetic brush being formed by housed magnetic poles and the imparting of a developer bias onto the development sleeve at a position opposing a latent image carrier (hereinafter referred to as photoreceptor) have been hitherto widely employed.

These two-developer component systems are widely employed because of the simplicity of color development that they afford. In these systems the two-component developer is carried to a development region accompanying the rotation of the development sleeve. As the developer is being carried to the development region a large number of magnetic carriers in the developer, while aligning themselves with the magnetic lines of force of a developer electrode, aggregate in company with the toner to form a magnetic brush.

Unlike single-component developer systems, in two-component developer systems the precise control of the toner-carrier weight ratio (toner density) is a very important factor in terms of improving stability. For example, when the toner density is too high a soiling of the image skin of a drop in the fine resolution of the image occurs. In addition, low toner density results in an unwanted drop in the density of the solid image part and adherence of the carrier. Accordingly, the toner supply amount must be controlled to adjust the toner density in the developer to the appropriate range.

The toner density control performed here is based on a comparison of an output value of toner density detection means (for example, permeability sensor); Vt and a toner density control reference value; Vref, a calculation of a toner supply amount in accordance with the difference thereof from a calculation formula, and the implementation of toner supply to a development unit by means of a toner supply device.

As the method for detection of toner density a magnetic sensor is normally employed. In this system magnetic permeability changes in the developer produced by changes in the toner density are converted to toner density changes.

Another method of toner density detection employs an optical sensor. This method involves the production of a reference patch on an image carrier or intermediate transfer belt and irradiation of an LED light. The reflected light from the pattern thereof (normal reflected light or diffuse reflected light) is detected by an optical sensor (photodiode or phototransistor or the like) and, based on the result thereof, the toner density (toner adhered amount) is detected.

In another known method for toner density control performed during printing a reference toner pattern is produced between sheets of transfer paper (in the time, or an interval, between when a directly preceding image formation has finished and the forming of the next image is to start), and the toner density control reference value: Vref of a magnetic permeability sensor is successively controlled.

Japanese Unexamined Patent Application No. S57-136667 describes a method comprising means for producing a toner pattern on a non-image part and detecting pattern density and toner density in a development unit in which, in accordance with the density of the toner pattern, image density is maintained by change of a toner density control target value of a development unit.

However, there is a desire for the excessive use of toner that occurs in actual practice when toner patterns are produced between sheets of paper to as far as possible be reduced, and correction based on production of reference toner patterns between sheets of paper is tending now towards an expanding of the interval between the production of the toner patterns, or indeed to not being performed at all.

Furthermore, in the production of toner patterns on an intermediate transfer belt, if the secondary transfer roller is not separated when each individual is formed, a toner cleaning device must be additionally provided to clean the patches of toner between the sheets of paper that adhere to the secondary transfer roller.

In addition, if the secondary transfer roller is separated when each individual image is formed (or several images are formed), while there is no need for a cleaning device to be provided, a mechanical mechanism able to withstand the frequently occurring secondary transfer separation and contact is necessary. For the reason described above, as well as from the viewpoint of reducing the mechanical costs, the toner patterns produced between the sheets of paper must as far as possible be suppressed.

In addition, for example, Japanese Patent No. 3,410,198 discloses, in the implementing of a toner supply control employing a toner density sensor, a method for maintaining the toner density constant by correcting and stabilizing the fluctuations in toner density sensor output produced by changes in the flow state of the developer in accordance with the agitation time.

However, even if a constant toner density is maintained, unless the development capability of the developer is stable, it is difficult to maintain a stable image density by simply keeping the sensor output constant.

In addition, in many of the image formation apparatuses of recent years means for reducing stress in the development device have been incorporated. These methods are regarded as very effective means by which the objects of a lowering of the amount of developer arising because of the demand for the miniaturization of development devices while reciprocally extending the lifespan of the developer are able to coexist. For example, while additives such as silica ($SiO_2$) or titanium oxide ($TiO_2$) are externally affixed (adhered) to most of the surface area of the toner surface in order to improve toner dispersibility in color two-component image forming apparatus, these additives have little resistance to mechanical stress and heat stress. Accordingly, during agitation within the development unit, a phenomenon in which they either become embedded in the toner inner part or separate from the surface thereof occurs and, while changes in the flow and charge characteristics of the developer (including the toner and carrier) and, furthermore, the physical adhesion force between the toner and carrier occur, these phenomena are able to be as far as possible suppressed by these additives.

On the other hand, sometimes the toner charge capability (capability of development unit to change the toner) drops as a result of the lowering of the stress of the development unit.

Briefly describing the development process, for example, while the development capability (gradient of a graph in which toner developer amount to developer bias is plotted) is kept constant when an image of low image coverage ratio is output (low toner replacement amount per unit time or unit number of sheets), the development capability increases when an image of high image coverage rate (large toner replacement amount per unit time or unit number of sheets) is output. In other words, differences in development capability occur in accordance with the amount of toner replaced in the developer.

Because, by virtue of this, differences in development capability occur even when the toner density remains unchanged, the toner density in the development unit must be manipulated to the appropriate range by, in order to keep the development capability constant over time, changing the toner density control reference value. Because, as a result, changes in the development capability also occur when the toner density changes, the image forming conditions (development potential) must be set in accordance therewith.

When image forming apparatuses having these characteristics dispense with a conventional composite control comprising a magnetic permeability sensor and a photosensor in which the image density control reference value is changed on the basis of toner patch production on the paper there is a resultant need for the toner density control based on the use of magnetic permeability sensor alone to be implemented more precisely during continuous printing or changing of the image mode. Accordingly, an image density control system to replace the conventional composite control with a photosensor must be adopted.

SUMMARY OF THE INVENTION

Thereupon, it is an object of the present invention to provide an image density control method in which, in a system that does not implement a paper process control (change the toner density control reference value between transfer sheets of paper by producing at least one reference patch on a transfer belt and detecting the density thereof on the transfer belt by means of a photosensor), high quality images can be stably maintained by ascertaining changes in the image coverage ratio of output images (toner replacement amount of the developer in a fixed time period) based on a moving average of the image coverage ratio and, when the image coverage ratio is high, changing (resetting) the image forming conditions accompanying an updating of the development potential at predetermined execution intervals, and an image forming apparatus employing this method.

In an aspect of the present invention, in an image density control method, when a two-component developer comprising a toner and a magnetic carrier on which the toner is held is carried on a developer carrier arranged opposing an image carrier, and the toner is used to develop an electrostatic latent image formed on the surface of the image carrier in a development region formed between the developer carrier and image carrier, an image density control method employs a toner supply amount control device for keeping the toner density in the developer constant and a mechanism for determining a toner density control reference value to keep the development capability constant, and changes the toner density control reference value in accordance with the image coverage ratio of an output image. The method comprises the step of changing image forming conditions in accordance with the image coverage ratio of the output image to produce a constant image density.

In another aspect of the present invention, in an image forming apparatus, a two-component developer comprising a toner and a magnetic carrier on which the toner is held is carried on a developer carrier arranged opposing an image carrier, and the toner is used to develop an electrostatic latent image formed on the surface of the image carrier in a development region formed between the developer carrier and image carrier. By employing a toner supply amount control device for keeping the toner density in the developer constant and a mechanism for determining a toner density control reference value to keep the development capability constant, the toner density control reference value is changed in accordance with the image coverage ratio of an output image, and image forming conditions are changed in accordance with the image coverage ratio of the output image to produce a constant image density.

In another aspect of the present invention, when a two-component developer comprising a toner and a magnetic carrier on which the toner is held is carried on a developer carrier arranged opposing an image carrier, and the toner is used to develop an electrostatic latent image formed on the surface of the image carrier in a development region formed between the developer carrier and image carrier, an image density control method employs toner density detection means, a toner supply amount control device for keeping the toner density in the developer constant and a mechanism for determining a toner density control reference value to keep the development capability constant, to change the toner density control reference value in accordance with the image coverage ratio of an output image and to determine an execution interval for changing image forming conditions in accordance with the image coverage ratio of the output image. The method comprises the step of updating the toner density control reference value using a detected value of the toner density detection means as a reference.

In another aspect of the present invention, in an image forming apparatus, a two-component developer comprising a toner and a magnetic carrier on which the toner is held is carried on a developer carrier arranged opposing an image carrier, and the toner is used to develop an electrostatic latent image formed on the surface of the image carrier in a development region formed between the developer carrier and image carrier. By employing toner density detection means, a toner supply amount control device for keeping the toner density in the developer constant and a mechanism for determining a toner density control reference value to keep the development capability constant, the toner density control reference value is changed, an execution interval for changing image forming conditions is determined in accordance with the image coverage ratio of an output image, and the toner density control reference value is updated using the detected value of the toner density detection means as a reference.

BRIEF DESCRIPTION OF THE DRAWINGS

The above and other objects, features and advantages of the present invention will become more apparent from the following detailed description taken with the accompanying drawings in which:

FIG. 7 is a diagram of an example of a look-up table (LUT);

FIG. 10 is a diagram showing image condition 1 and condition 2 pertaining to power source ON, front cover closed, energy saving mode reversion, interruption and JOB end when the moving average of the image coverage is at least 20% and when it is less than 20%.

DESCRIPTION OF THE PREFERRED EMBODIMENT

An embodiment of the present invention will be hereinafter described in detail with reference to the drawings.

Figure 1:
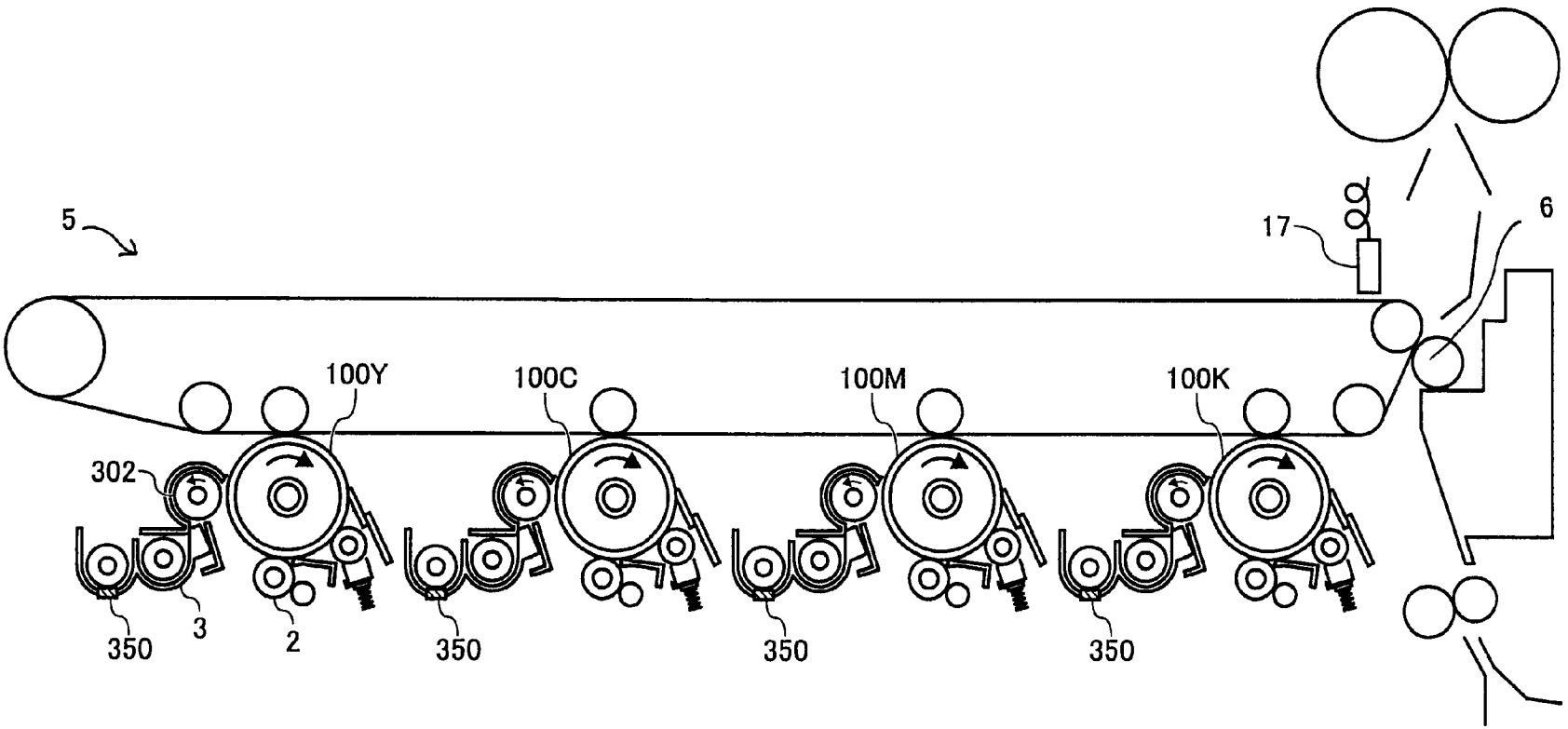
FIG. 1 shows schematically the configuration of the main part of an image forming apparatus pertaining to an embodiment of the present invention.

FIG. 1 shows schematically the configuration of the main body of an image forming apparatus pertaining to the embodiment.

The symbol 2 in the diagram denotes a charging device, 3 denotes a development device, 5 denotes an intermediate transfer device, 6 denotes a secondary transfer device, 17 denotes an optical sensor, 100 denotes a photoconductive drum, and 302 denotes a development sleeve or roller.

The surface of the photoconductive drum 100 is uniformly changed by the charging device 2 and then exposed to a light from an optical system not shown in the diagram to form an electrostatic latent image. The development device 3 carries the developer within the device by means of the development roller 302 to a developer nip region opposing the photoconductive drum 100 whereupon the toner in the developer adheres to the electrostatic latent image formed on the photoconductive drum surface producing a toner image. The toner image is transferred onto the belt of the intermediate transfer device 5 in the transfer region in which the photoconductive drum 100 and intermediate transfer device 5 are opposing. Accompanying the movement of the transfer belt, the toner image transferred onto the belt of the intermediate transfer device 5, is carried to a position opposing the secondary transfer device 6 in a state in which toners of other colors have been precisely color-superposed at transfer regions for other colors and, at this position, is transferred to a transfer member to produce an image on the transfer paper.

The residual toner on the photoconductive drum 100 that has passed the cleaning device is removed by a cleaning device and held in a discharge toner vault not shown in the diagram. The surface of the photoconductive drum 100 is then uniformly recharged by the charging device 2 before the next image forming step is repeated.

Next, the image forming apparatus of this embodiment will be described.

Figure 2:
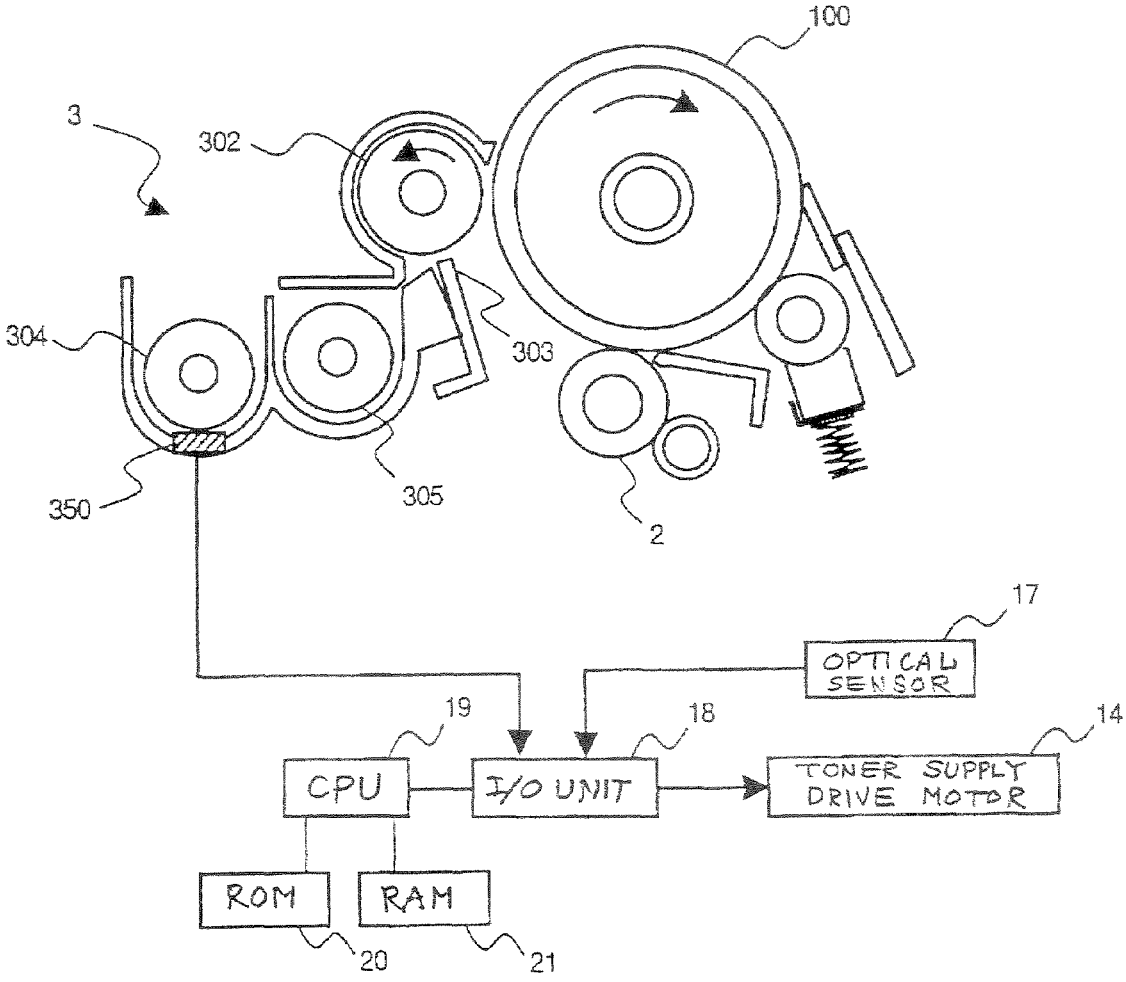
FIG. 2 shows schematically a cross-section of the configuration of this image forming apparatus.

FIG. 2 schematically shows the cross section of the image forming apparatus described above.

The symbol 14 in the diagram denotes a toner supply drive motor, 18 denotes an I/O unit or board, 19 denotes a CPU, 20 denotes an ROM, 21 denotes an RAM, 303 denotes a doctor edge part, 304, 305 denote carry screw parts, and 350 denotes a magnetic permeability sensor.

Here the two-component developer (hereinafter referred to as the developer) is moved by drawing magnetic poles of the development roller 302 from the carry screw part 305 of the development unit to the development roller 302. Thereafter the developer, accompanying the rotation of the development roller 302, is carried to the proximity of the doctor by the magnetic field of a carrying pole and the frictional force of the surface of the development roller 302. The developer carried in proximity of the doctor is temporarily held in the upstream part of the doctor where, before being carried to the development region, the layer thickness thereof is adjusted by a gap (Gd) between the doctor edge part 303 and development roller 302. Because a predetermined developer bias is imparted to the development region and a development electric field is formed in the direction in which the toner is urged toward the electrostatic latent image formed on the photoconductive drum 100, the toner is developed on the photoconductive drum 100. In addition, the developer that has passed the development region is separated from the development roller 302 at the position of a developer separation terminal on the development roller before being returned to the carry screw part 305. After this, the developer is moved to the carry screw part 304 and, by the toner supply unit, is adjusted to a suitable toner density before being carried again to the development roller 302. A magnetic permeability sensor 350 is arranged in the base part of the casing of the development unit 3, and the toner density in the developer is detected by this sensor.

Each of the magnetic permeability sensor 350 and optical sensor 17 (in the position of arrangement described by FIG. 1) are connected to the I/O unit or board 18 by way of A/D converters not shown in the diagram. A control unit comprising a CPU 19, read specific memory (ROM) 20 and read write memory (RAM) 21 and I/O board 18 is configured to transmit a control signal by way of the I/O board 18 to a motor 14 for driving a supply device not shown in the diagram. The RAM 21 comprises a Vt resistor for temporarily storing an output value Vt of the magnetic permeability sensor 350 read from the I/O board 18, a Vtref resistor for storing a toner density control reference value Vtref of the development unit 3, and a Vs resistor arranged in proximity of the intermediate transfer belt for storing an output value Vs from the optical sensor 17. A toner density control program and an image density control parameter correction program are stored in the ROM 20.

Figure 3:
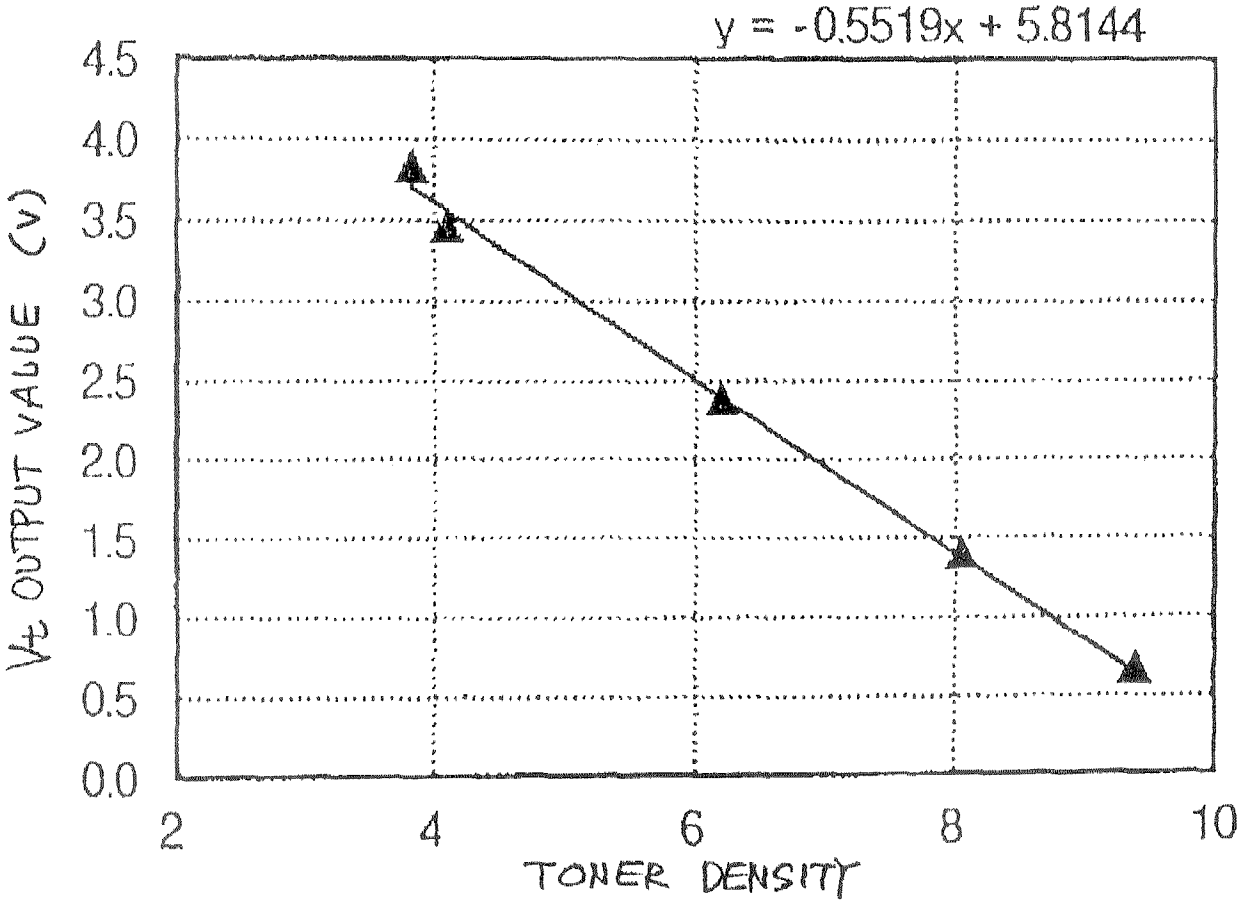
FIG. 3 is a graph of the density to output relationship.

FIG. 3 shows the relationship between density and output.

First, the toner supply control executed on each occasion that a printing process is carried out will be described. As shown in the diagram, the output of the magnetic permeability sensor 350 described by the vertical axis and the toner density described by the horizontal axis approximate a straight line across the entire toner density range. As is clear therefrom, the diagram exhibits the characteristic of the higher the toner density the lower the output value. Here, the output value of the magnetic permeability sensor 350 which indicates the current toner density is taken as Vt, and the toner density control reference value is taken as Vtref. When Vt is larger than Vtref, the toner supply device motor is driven to effect a toner supply operation that eliminates this Vtref-Vt difference. Conversely, when Vt is less than Vtref, a control is performed to stop the toner supply device motor and prevent the supply of toner.

Figure 4:
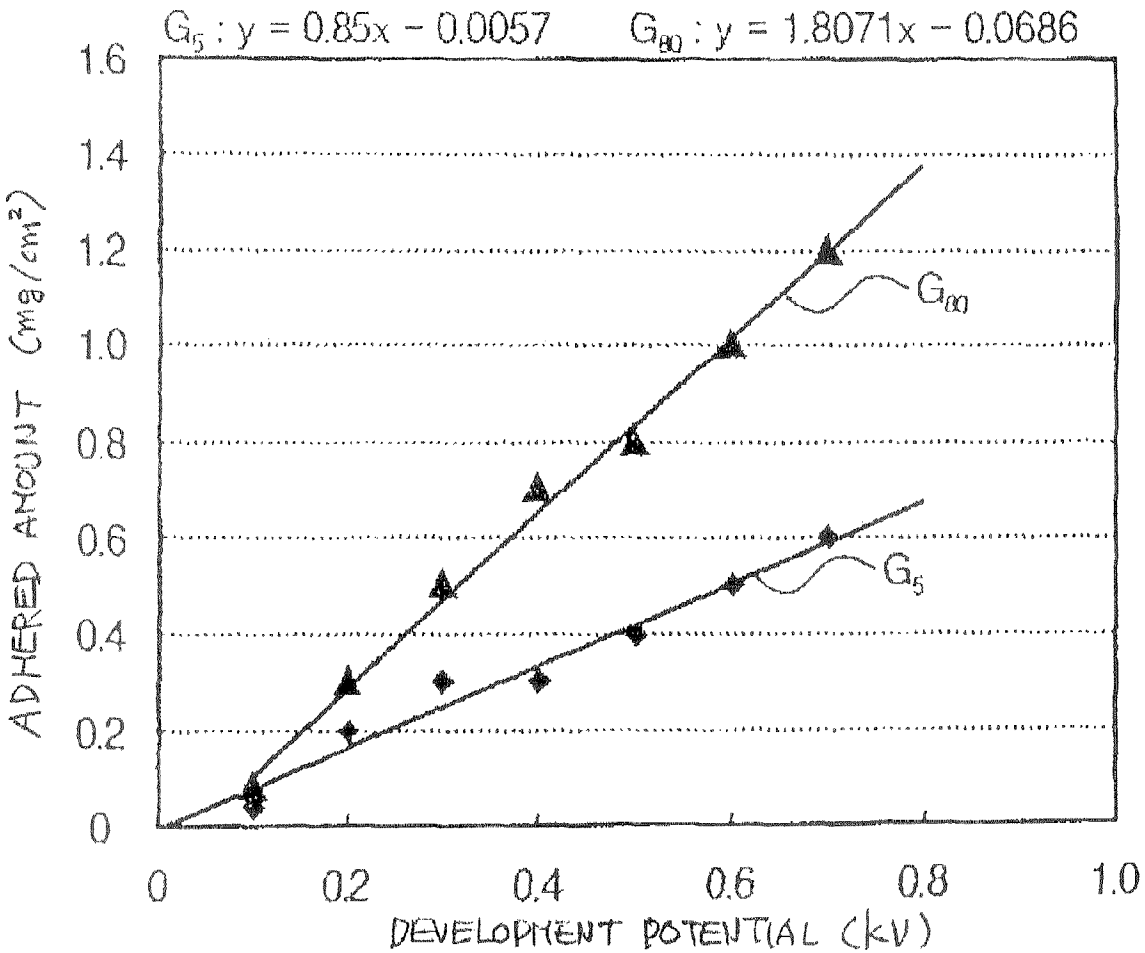
FIG. 4 is a graph of toner adhered amount versus development potential.

FIG. 4 shows the toner adhered amount versus the development potential.

The method for measuring the developer characteristic values and method of correction of this embodiment will be hereinafter specifically described.

This diagram shows the difference in development γ according to the output image coverage (gradient of the relational expression of toner adhered amount to development potential). The values were obtained for 100 copies of an image of the same image coverage ratio continuously output at a standard line speed mode (138 mm/sec) and, as is clear from the diagram, even when the toner density is the same, the greater the toner replacement amount in a fixed time period (higher the image coverage) the higher the development γ. This implies a change in the physical adherence force and the electrostatic adherence force of the toner and the carrier. In other words, a correction that takes into account differences in development capability produced by differences in the toner replacement amount in a fixed time period is required.

In earnest research carried out by the (nine) inventors of the present invention with these problems in mind led to the consideration of a means in which implementation of a control (theoretically, changing the toner density control reference value to produce a constant development γ, in other words, to produce a constant toner charge amount) to manipulate the toner density in a direction that stabilizes the developer effective was found effective and, in addition, in which resetting the image forming conditions including the development potential (developer bias, charging voltage, LD light amount and various environmental conditions and so on) in accordance with need was found to produce a more stable image.

Here, the method for setting the developer bias will be described.

First, the developer is thoroughly agitated to stabilize the state of the developer. Next, in order to measure the development γ (development capability), the development potential is changed and density measurement patches of ten tones are produced on the photoreceptor 100. The patches are formed as images by fixing of the electric potential of a writer unit and changing the developer bias. Whilst referred to as patches, they are sequentially formed as images from the side of lowest development potential. Next, the toner developed on the photoreceptor 100 of each station is transferred to the intermediate transfer belt. While in this embodiment ten density measurement patches are produced by each station, measurement of the development γ is possible using fewer patches. Ideally, three or more different types of density measurement part of changed density are produced. The density of the density measurement patches of the various colors juxtaposedly transferred on the intermediate transfer belt is simultaneously measured by four photosensors juxtaposedly arranged in rows in the downstream of the direction of rotation of the intermediate transfer belt. Following this, the patch density is converted to a toner adhered amount [mg/cm$^2$], and a relational expression of adhered amount [mg/cm$^2$] to development potential [−kV] is obtained. The gradient of the above relational expression denotes the development γ which indicates the development capability [mg/cm$^2$/(−kV)]. This shows that when the development γ is low the development capability is low and, conversely, when the development γ is high the development capability is high.

In addition, the developer bias voltage for obtaining the target toner adhered amount can be calculated from this relational expression.

While both image area [cm$^2$] and image coverage ratio [%] may be considered for determining the toner replacement amount in a fixed time period, the employment of image coverage ratio is the simplest and easiest to understand. The unit of measurement of the toner replacement amount in a fixed time period when image coverage ratio is employed is [mg/page], and correction is performed in accordance therewith. When a 100% solid image is output on a A4-size transfer paper 300 [mg] of toner is used and, accordingly, because 300 [mg] of toner is supplied, the toner supply amount is 300 [mg/page].

However, because the image coverage ratio is used for the toner replacement amount, a measure for, for example, establishing the image coverage ratio by setting the standard transfer paper to a long-edge feed A4-size paper and converting all the transfer paper to this size is required. Incidentally, the developer capacity of the development device employed in this test was 240 [g].

Figure 5:
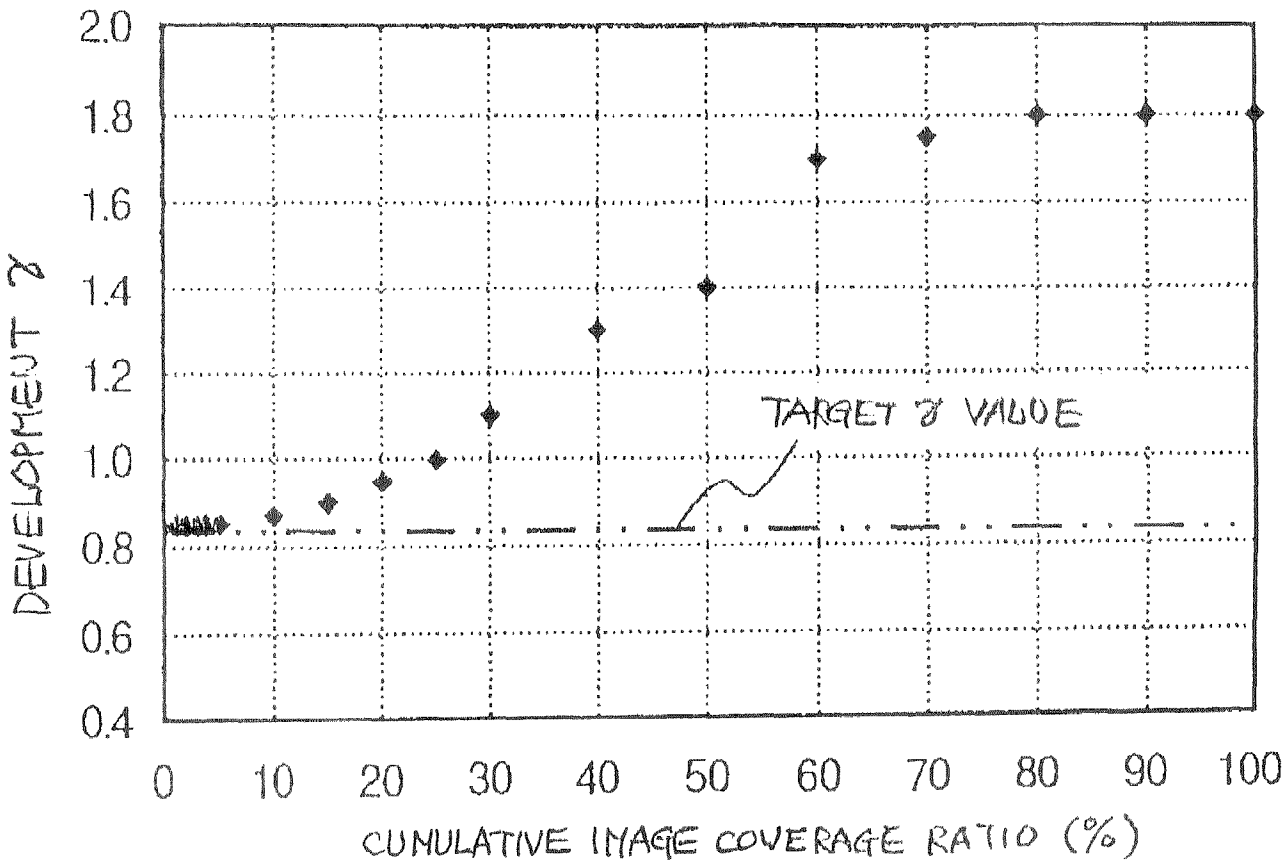
FIG. 5 is a graph of development γ versus image coverage ratio.

FIG. 5 shows the development γ versus the image coverage ratio.

The horizontal axis in the diagram describes the image coverage ratio [%] and the vertical axis describes the development γ [mg/cm$^2$/(−kV)]. In this test method, similarly to that described above, 100 copies at each image coverage ratio were continuously printed at a standard line speed mode [138 mm/sec] with the toner density kept constant. As is clear therefrom, the diagram exhibits the tendency that exists for the development γ to increase when the image coverage ratio exceeds the reference value: 5%. Based on this, when the image coverage ratio is higher than 5%, the toner density must be manipulated lower by increasing the toner density control reference value: Vtref. Conversely, there is a tendency for the development γ to decrease when the image coverage area rate is less than 5%. Accordingly, the toner density must be manipulated higher by decreasing the toner density control reference value: Vtref.

While the development γ gradually changes as a result of the toner density having been manipulated in this way, it is not necessarily the case that the development γ has been optimized as a result of the manipulating of the toner density. A more stable output image density can be produced by determining the image forming conditions that correspond to the development γ.

Figure 6:
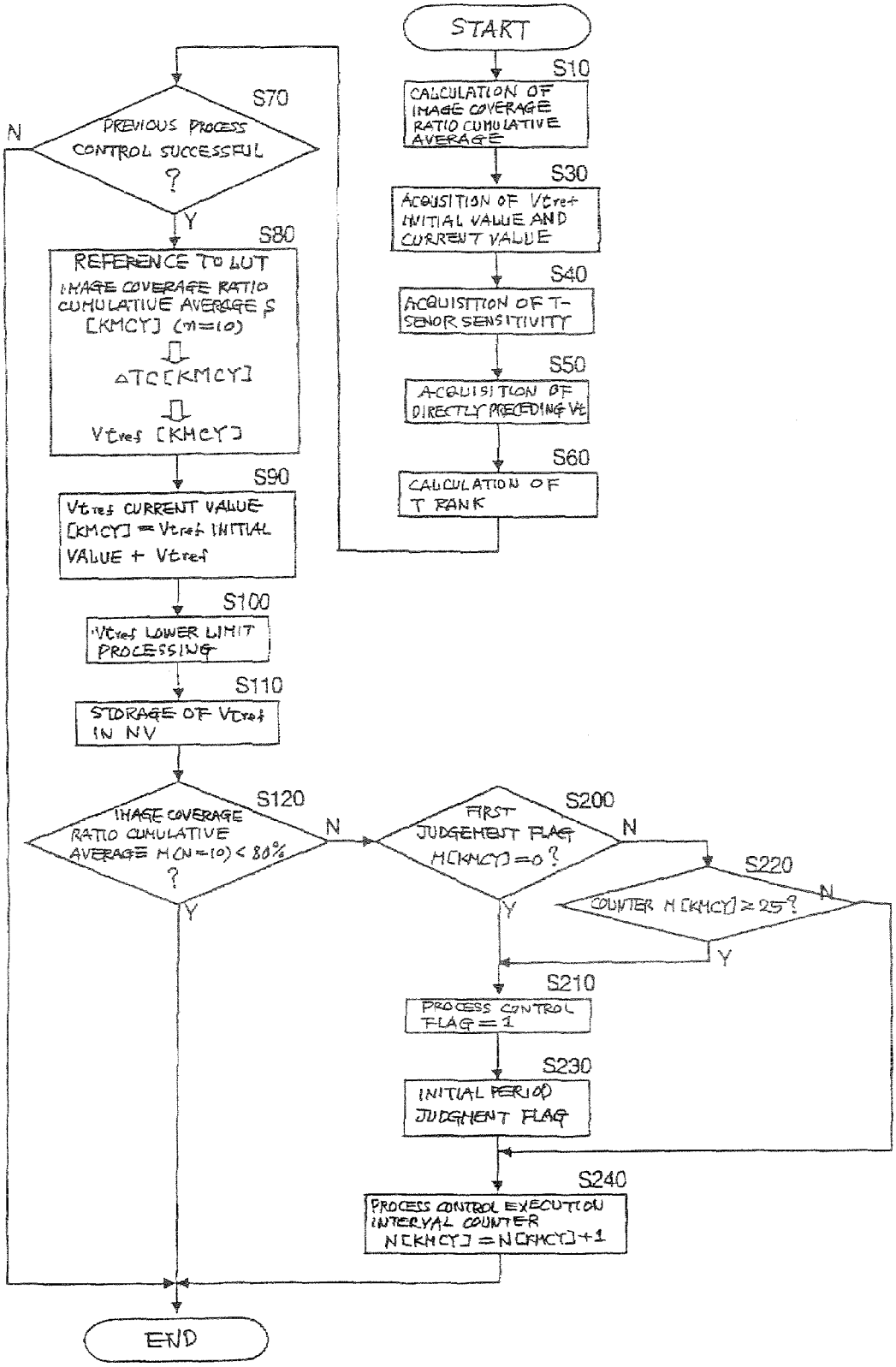
FIG. 6 is a flow chart of the correction process.

FIG. 6 shows the steps in the correction process.

This correction will be described in accordance with the flow chart of FIG. 6.

The correction is initiated whenever a print JOB is completed. First, in STEP 10, the average of the image coverage ratio of output images [unit:%] is calculated. The calculation of the average of the image coverage ratio involves calculation of the image coverage ratio of each individual printed sheet. While an average value of the image coverage ratio from a certain point in time may be used to execute this correction (for example, taking the point in time at which an electric potential control is performed as zero, the overall average from this point), the employment of a moving average thereof is preferred. The toner replacement history for several previous sheets that is suitable for ascertaining the current developer characteristics can be ascertained by employing the average moving value. By changing the toner density control reference value as appropriate employing an average moving value, the image density can be stably controlled without the development γ being significantly changed. In addition, because the toner density control reference value can be corrected in accordance with the toner replacement amount in any fixed time period, this process can be used for all image output patterns.

While for the moving average a simple averaging of each previous several sheets may be used, in the present embodiment the moving average is calculated in accordance with the expression (1) noted below. This is very effective from the viewpoint of the fact that, by employing this calculation expression, the need for an image coverage ratio for several sheets (taken to be N sheets) from a previous several or several tens of sheets to be stored in the NXV-RAM is eliminated.

$$M(i)=(I/N)(M(i-1)\times(N-1+X(i)) \quad \text{Expression 1}$$

Here, M(i) denotes the current image coverage ratio moving average value, M(i−1) denotes the previous image coverage ratio moving average value, and N denotes the number of cumulative sheets. In addition X(i) denotes the current image coverage ratio. M(i) and X(i) are individually calculated for each color. The usage range of the NV-RAM can be markedly reduced by, as in this embodiment, employing previous moving averages of the image coverage ratio to obtain the current moving average value. In addition, control response can be changed by changing the cumulative number of copies N and, for example, more effective control is possible if the value is changed over time and in accordance with environment fluctuations.

Next, in STEP 30, a current Vtref value and an initial Vtref value are acquired. The initial Vtref value and current Vtref value are defined by expression (2) below:

$$\text{Current } Vtref \text{ value} = \text{Initial } Vtref \text{ value} + \Delta Vtref \qquad \text{Expression (2)}$$

(individually calculated for each color [KMCY].)

The ΔVtref constitutes a Vtref correction amount calculated from the LUT (look-up table) and is determined from expression (3) noted below. The details thereof will be described later.

Next, in STEP 40, the sensitivity information of the T-sensor is acquired. The sensitivity of the T-sensor is expressed by the unit [V/t %] and is a value peculiar to the sensor (the absolute value of the gradient of the straight line plotted in FIG. 3 denotes the sensitivity.). Next, in STEP 50, a directly preceding T-sensor output value: Vt is acquired. Next, in STEP 60, Vt-Vtref is calculated. Following this, in STEP 70, a judgment as to whether the correction is to be implemented or not is made.

As judgement criteria, for example, whether or not the previous electric potential control was a "success", or whether or not the Vt-Vtref falls within a predetermined value (whether or not the toner density control is being normally executed) and so on may be employed. If there is no correction to be executed the process finishes at that point.

If a correction is to be executed, in STEP 80 reference is made to an LUT. FIG. 9 shows one example of a LUT. The precision of the control is improved by fine control based on the employment of the LUT. In addition, the control steps and the change of the maximum correction value are also comparatively easy to perform.

FIG. 9 shows a T-sensor of sensitivity 0.3.

First, the ΔTC (amount that the toner density is changed) changed in accordance with the moving average of the image coverage ratio is determined. After the ΔTC has been determined, the ΔVtref is calculated employing the T-sensor sensitivity calculated in STEP 40. The calculated ΔVtref is stored in the NV-RAM. The calculation expression is shown by expression (3) below. The ΔVtref in the table constitutes values obtained by this expression.

$$\Delta Vtref = (-1) \times \Delta TC \times T\text{-sensor sensitivity} \qquad \text{Expression 3}$$

(individually calculated for each color [KMCY].)

Figure 8:
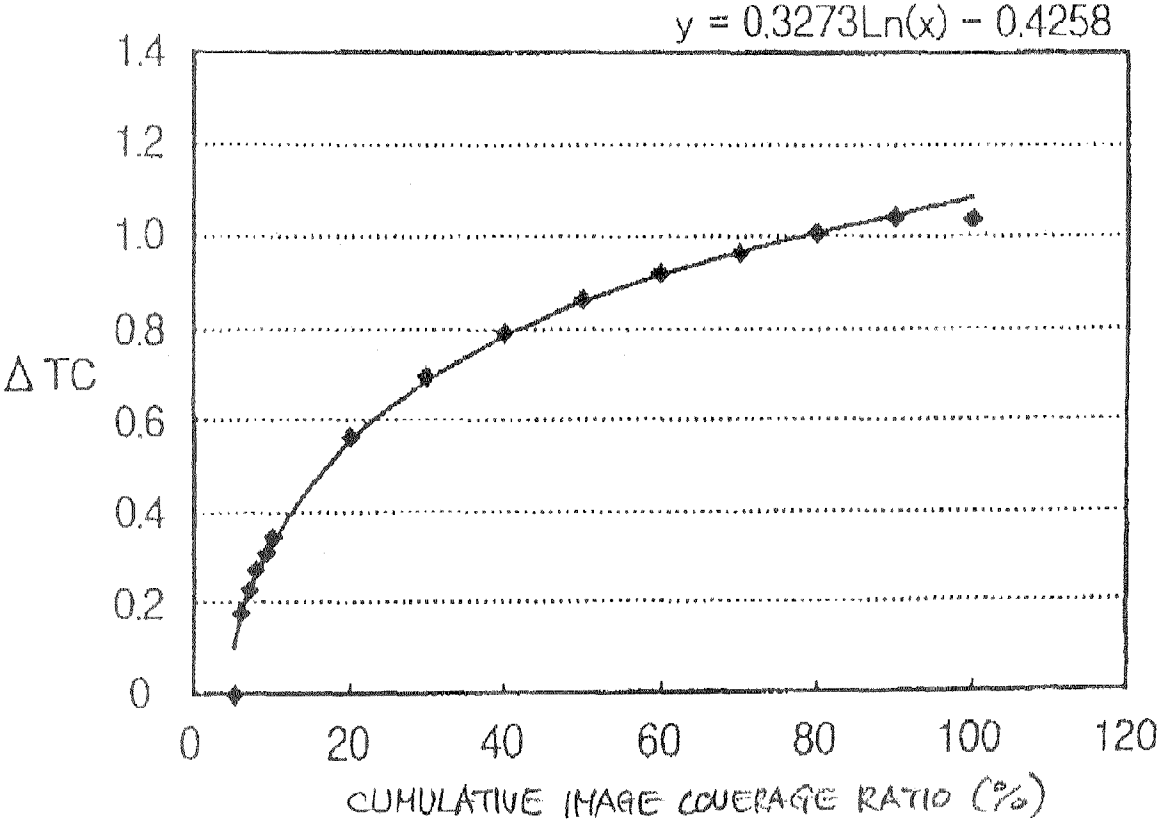
FIG. 8 is a graph of toner density change amount versus image coverage ratio.

FIG. 8 shows the toner density change amount versus image coverage ratio.

The LUT used in this embodiment is produced employing the following means. FIG. 8 expresses a toner density change amount (wt %) for keeping the development γ constant based on the setting of a standard TC (toner density) versus changes in the image coverage ratio. For example, when the image coverage ratio is 80%, the development γ is kept constant when an image is output by using an ΔTC of 1 [wt %].

The ΔTC correction amount with respect to the image coverage ratio can be most precisely approximated by means of logarithmic approximation. Accordingly, ΔTC amounts with respect to the image coverage ratio employed in the LUT are determined employing this method.

In addition, in this example, when the image coverage ratio is less than 10% a correction step is set for each 1% image coverage ratio, and when the image coverage ratio is 10% or more, a correction step is set for each 10%. The correction steps can be arbitrarily changed in accordance with the characteristics of the developer and the development device. Adjustment of the maximum correction amount for each color involves correction based on the employment of the following expression.

$$\Delta Vtref = (-1) \times \Delta TC \times T\text{-sensor sensitivity} \times \text{color correction coefficient} \qquad \text{Expression (4)}$$

The weighting of the control can be easily changed by changing the maximum correction amount. For example, more effective control is possible if the value is changed over time and in accordance with environment fluctuations.

Using color image forming apparatuses sometimes the correction amount must be changed at each station because of differences in the developer characteristics. Correction can be efficiently executed by setting LUT independently for the plurality of development devices.

After the ΔVtref has been calculated in STEP 80, the current Vtref value is calculated in STEP 90. Employing the current Vtref value and initial Vtref value acquired in STEP 30, the Vtref is calculated in accordance with the following expression (5):

$$\text{Current } Vtref \text{ value} = \text{Initial } Vtref \text{ value} + \Delta Vtref \qquad \text{Expression (5)}$$

(individually calculated for each color [KMCY].)

Next, in STEP 100, a Vtref upper/lower limit processing is performed. When the current Vtref value following correction exceeds an upper limit value set in advance the current Vtref value is taken to be the upper limit value. When the post-corrected Vtref exceeds the lower limit value, the current Vtref value is taken to be the lower limit value set in advance. Following completion of the upper/lower limit processing, in STEP 110 the current Vtref value is stored in the NV-RAM.

The fundamental process flow in the changing of the image forming conditions will be described.

In STEP 120, a judgment as to whether or not the image coverage cumulative average exceeds a predetermined image coverage ratio (here 80%) is made. The image coverage ratio cumulative average employed in STEP 120 is independent to the cumulative average of STEP 10. By virtue of it being independent, the Vtref correction and frequency of the process control of the later-described STEP 210 (operation for changing image forming conditions; process control) can be independently adjusted. In STEP 120, if the image coverage cumulative average does not exceed the predetermined image coverage ratio, the process finishes at that point. If the judgment made in STEP 120 is that the predetermined image coverage ratio has been exceeded, a confirmation of a first judgment flag M[KMCY] in STEP 200 is performed.

When the first judgment flag is not set (=0) it implies a first processing control being executed upon the conditions of STEP 120 being fulfilled. Thereupon, in the next STEP 210, a process control flag is set (=1) and a process control executable state is established. Next, a first judgment flag M[KMCY] is set in STEP 230, and 1 is added to a process control execution interval counter N[KMCY] in STEP 240 and the process finishes.

When the first judgment flag M[KMCY] of STEP 200 is set a confirmation of the process execution interval counter N[KMCY] is made in STEP 220. If the process execution interval counter N[KMCY] does not exceed a predetermined value (here, 25), 1 is added to the process execution interval counter N[KMCY] in STEP 240 and the process finishes. When the process execution interval counter N[KMCY] exceeds a predetermined value (here, 25) it implies that, after a previous process control has been executed, an interval available for executing of another process control exists. (only time adjustment, of which the significance is small, is required when process controls are continuously executed.). Thereupon, in the following STEP 210, the process control flag is set (=1) and a process control executable state is formed. Next, in STEP 230, the first judgement flag M[KMCY] is set, and 1 is added to the process execution interval counter N[KMCY] in STEP 240 and the process finishes.

Because, by virtue of the counter N[KMCY] comprising independent counters for each color, correction responses can be individually set, finer control in accordance with the image coverage ratio can be performed.

By virtue of the process execution interval counter N[KMCY] being cleared when a process control is to be executed, a suitable interval for changing of the image forming conditions can be maintained eliminating the need for continuous change of the image forming conditions. Accordingly, this is effective from the viewpoint of suppressing overcorrection, as well as "wait-time shortening".

Next, the method for calculating the toner density control reference value: current Vtref value when the image forming conditions are being changed will be described.

The current Vtref value when the image forming conditions are being changed is first set in accordance with the degree of displacement of the current development γ value with respect to the target development γ value noted above. For example, when the target development γ value is 0.8 [mg/cm$^2$/−kV] and the current development γ value is 0.7 [mg/cm$^2$/−kV], the development capability is deemed to be lower than the target development capability. In this case, in order to increase the development capability, a control to lower the current Vtref value and increase the toner density is performed.

This pertains to the case of the Vtref being newly set, and it is normally desirable for this to be determined on the basis of, using the toner density detection means output value: Vt at the time of agitation prior to changing of the image forming conditions as a reference, the extent to which the toner density has increased or decreased from this value.

However, regarding the output value of toner density detection means, during the continuous output of an image of high image coverage ratio when the normal print operation is temporarily suspended and the image forming conditions are changed in this interruption or when an image of high image coverage ratio is continuously output, sometimes a Vt value at the time of agitation prior to the changing of the image forming conditions higher than really exists is output.

Here, regarding the a Vt acquisition time when the image forming conditions are changed, the development devices are normally driven for 5 to 10 sec either when the developer agitation is completed or immediately prior to agitation completion.

Figure 9A:
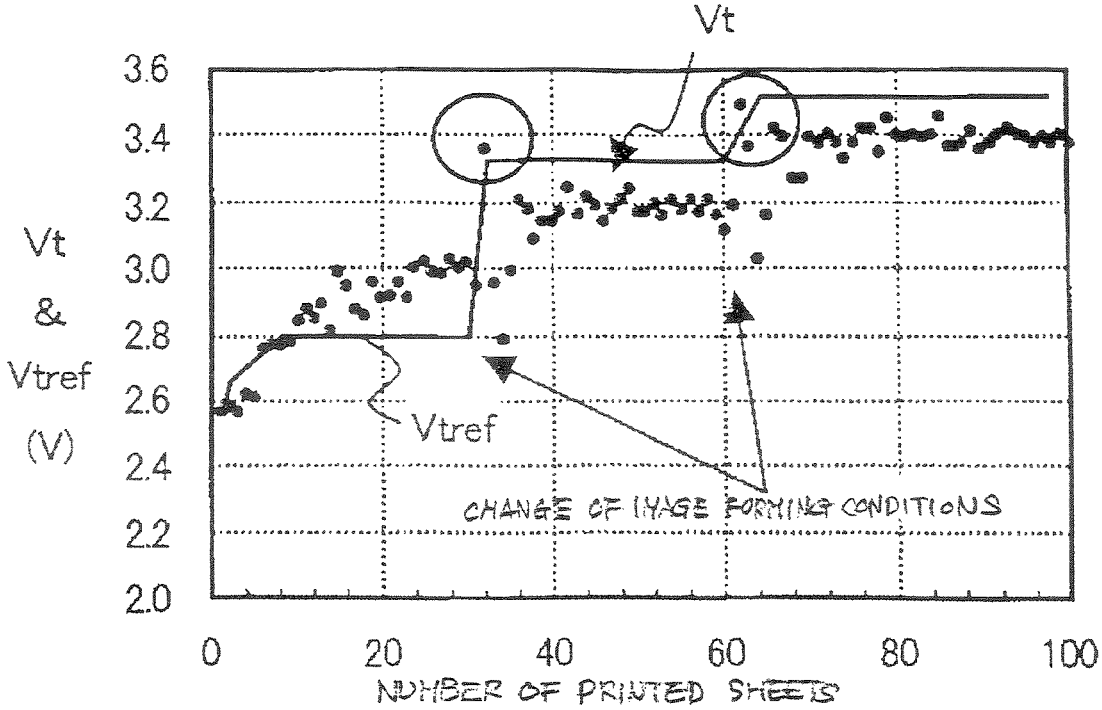
FIGS. 9A and 9B are graphs of change in Vt versus Vtref.
Figure 9B:
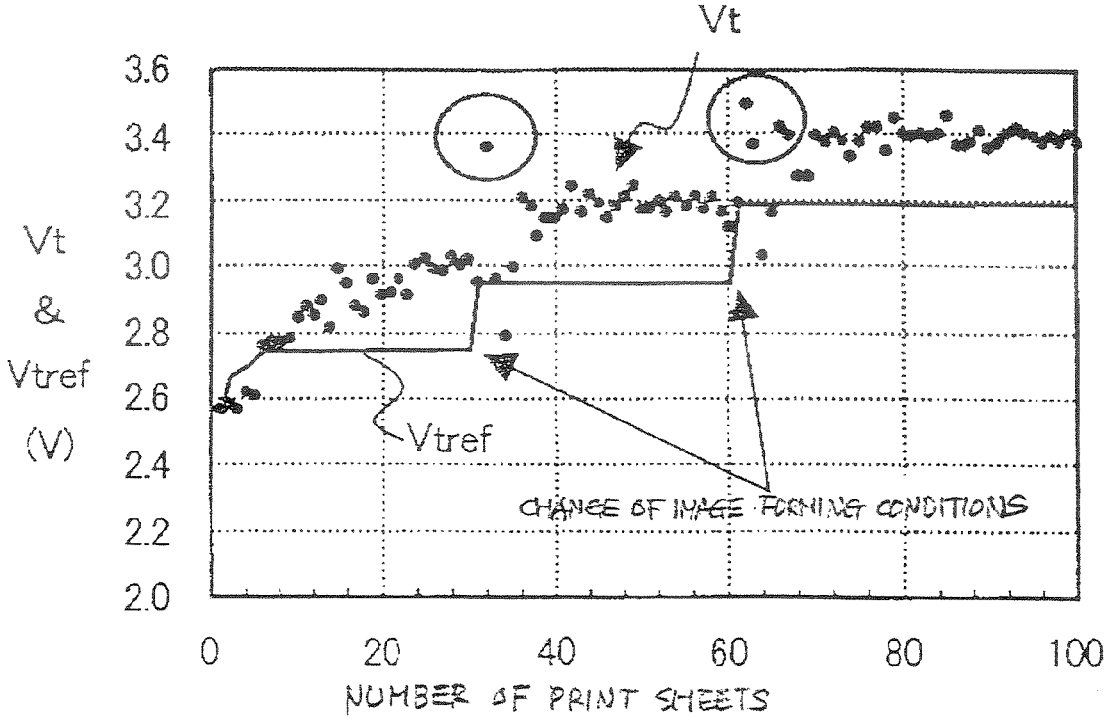

FIGS. 9A and 9B show the relationship between Vtref and Vt. FIG. 9A examines the conventional relationship between Vtref and Vt in the continuous repeated printing of 100 sheets of a 100% solid image. FIG. 9B examines the relationship between Vtref and Vt based on the present invention.

Vtref changes significantly when the image forming conditions are changed at the 30 sheet and 60 sheet interruption points. This is because, in the changing of the image forming conditions as described above, the Vt at the time of agitation is being employed to update the Vtref. Because of the marked drop in Vt comparative to Vtref that occurs when this control is performed, there is a possibility of a marked lessening of the image density of the output image occurring unless toner is supplied.

Because the changing of Vtref uses the acquired Vt as a reference value, a measure to prevent reference to irregular state Vt such as this is required.

The phenomenon occurs as a result of an image of high image coverage ratio being output and a developer of lowered toner density passing a toner density detector. The phenomenon is produced by employing a magnetic permeability sensor of very high response characteristics when performing the control in question, and with a conventional permeability sensor in which an averaging is performed it is essentially undetectable.

Accordingly, when an image of high image coverage ratio in which the occurrence of this kind of phenomenon may be predicted is output, the Vt detection method must be changed. There are several methods available for this including, for example, a method in which, when a 10 sec agitation time at the time of changing of normal image forming conditions is changed to around 30 sec, even if other adjustments (adjustment of AC bias imparted to the charging roller, adjustment of the electrical current value of the photosensor, and position displacement adjustment and so on) have been made prior to the image forming conditions being changed, a stable Vt value is able to be obtained. However, because this constitutes a departure from the concept of "wait-time shortening" of recent years, it cannot be regarded as a suitable method of resolution. Investigations carried out by the inventors of the present invention to find a more suitable method led them to conclude that acquisition of the Vt value at the time of directly preceding printing was the most efficient and accurate method. By adopting this detection method, as shown in FIG. 9(B), changing of the image conditions can be precisely implemented without need to increase the adjustment time. Because, by virtue of this, and appropriate amount of toner is supplied, control can be performed without inviting a drop in image density.

Incidentally, significant changes in the output value of toner density detection means sometimes occur due to changes in the charge amount [μc/g] or bulk density (loose apparent density) [g/cm$^2$] over time. For this reason, when an changing of the image forming conditions occurs when the apparatus is let stand, is reverted from the energy saving mode, or when the power source ON, the toner density detection means detected value: Vt must be acquired after thorough agitation of the developer, and the Vtref must be set with reference to this value.

The Vt value at the time of a directly preceding printing is employed in this embodiment when the moving average of the image coverage ratio (calculated employing expression (1) above) is at least 20% and either the changing of the image forming condition has been interrupted or a print Job has ended. If the moving average of the image coverage ratio is less than 20%, the Vt value at the time of agitation at the timing for changing the image forming conditions is referred to. As a result, the accuracy of the control is markedly improved. In addition, by adopting this detection method, a precise changing of image forming conditions can be performed without need for increased adjustment time.

The particulars of the description above are compiled in FIG. 10, the Vt method of detection adopted by the present invention being indicated in the double-framed section of this diagram only.

The conditions indicated in the table are outlined below.

Condition 1: When agitation is performed prior to changing of the image forming conditions, referral to the Vt at the time of agitation Condition 2: Even if agitation is performed prior to changing of the image forming conditions, referral to the Vt at the time of the directly preceding printing.

Moreover, it is desirable for correction to be executed during printing on the basis of the calculation of a correction value between transfer papers F (time between completion of a directly preceding image formation and the start of the next image formation, or paper interval). Because the toner density control reference value: Vtref can be appropriately calculated for each individual output image sheet by execution of the correction at this frequency, the image density can be better stabilized. In addition, because correction can be implemented in units of a single sheet or of several sheets of transfer paper without need to change the toner density control reference value: Vtref during printing, the density across the transfer paper is stable.

In addition, by independently altering the method of detection of Vt at only those stations that fulfill the conditions described above, the agitation time for stations that do not fulfill the conditions can be shortened. Accordingly, this is a factor in "wait time shortening".

Because agitation time has been conventionally set to conform to stations for which the most agitation time is required, the tendency has been for the agitation time prior to changing of the image forming conditions to be set long.

While the description given above is premised on the provision of a plurality of development devices (different colors), the method of image density control of the present invention is of a nature that can have application in a single development device and, accordingly, it can of course have application in a slngle-color image forming apparatus.

COMPARATIVE EXAMPLE

Figure 11:
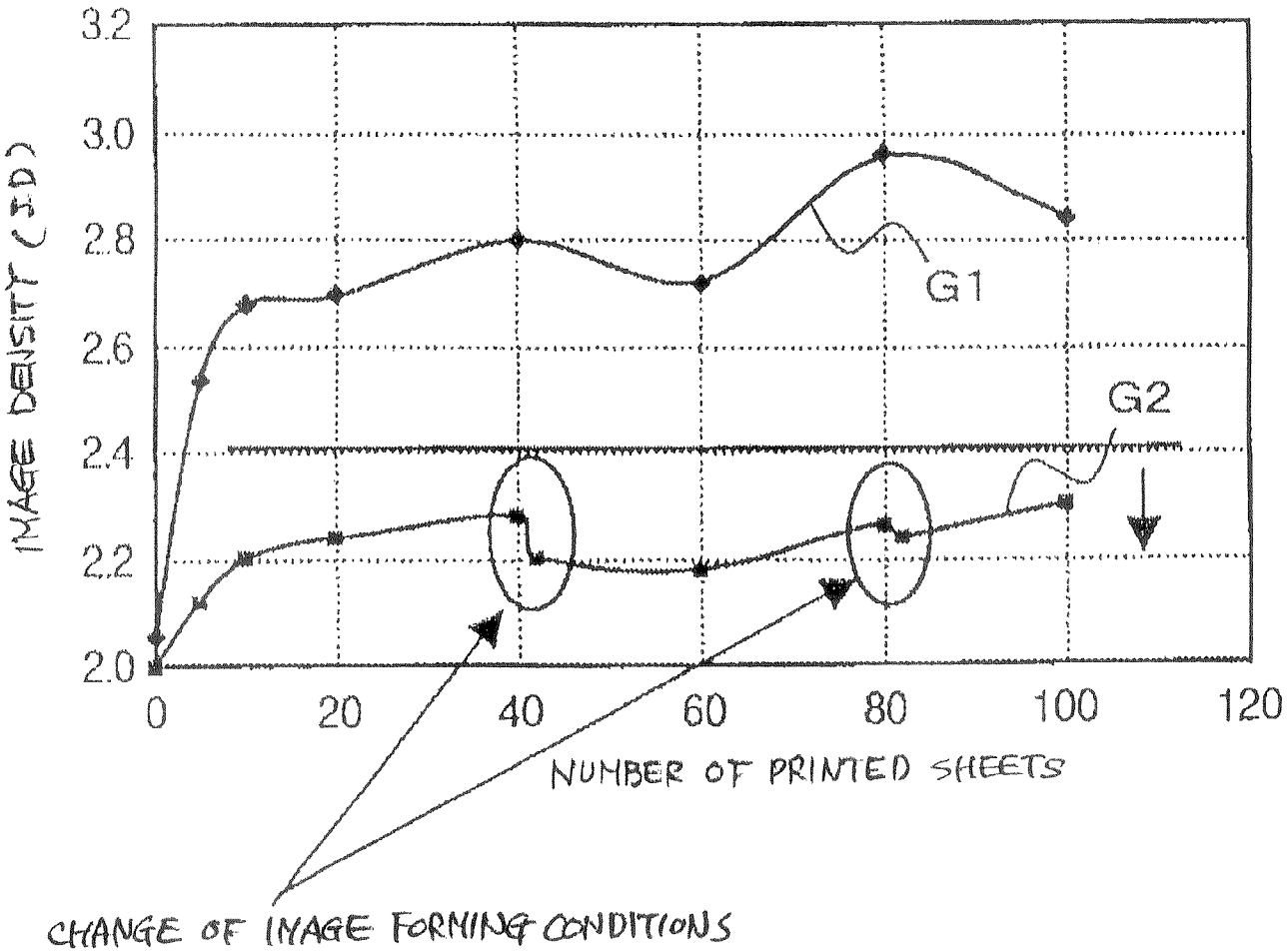
FIG. 11 is a graph expressing a comparison before and after the adoption of the image coverage ratio correction of the embodiment.

FIG. 11 expresses a comparison of before and after the incorporation of the image coverage ratio correction of this embodiment.

The symbol G1 in the drawing denotes a pre-correction curve and G2 denotes a post-correction curve.

As the image forming conditions, 100 sheets of an 80% solid image were continuously printed at the standard line speed mode (138 mm/sec). In the pre-correction measure curve G1, the ID (image density) increases as the print Job progresses. On the other hand, in the post-correction measure curve G2, the ID is controlled to be essentially constant by changing the image forming conditions with respect to ID which would otherwise increase. Incorporating the control of this embodiment affords a marked improvement in the image density stability of images in which there is large amount of toner replacement, in other words, in images of high image coverage ratio.

As is described above, according to the present invention, by changing the toner density image forming conditions as required in accordance with the toner replacement amount in a fixed time period in a developer and, furthermore, changing the image forming conditions at the optimum timing, the image density can be stably controlled without significantly changing the development γ.

Various modifications will become possible for those skilled in the art after receiving the teachings of the present disclosure without departing from the scope thereof.

What is claimed is:

1. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density;

executing an operation for changing said image forming conditions at predetermined intervals when the image coverage ratio of said output image fulfills predetermined conditions;

counting a number in which the image coverage ratio of said output image fulfills the predetermined condition; and determining said predetermined interval by a threshold number of said counting.

2. The image density control method as claimed in claim 1, further comprising clearing the value of said counter upon execution of the operation for changing said image forming conditions.

3. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density; and changing said toner density control reference value in accordance with a moving average of the image coverage ratio of the output image in a specified time period.

4. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density; and changing said toner density control reference value in accordance with a value M(i) obtained using the calculation formula:

$$M(i)=(1/N)(M(i-1)\times(N-1)+X(i)),\text{ where}$$

N: cumulative sheet number

M(i): current image coverage ratio moving average value

M(i−1): previous image coverage ratio moving average value and

X(i): current image coverage ratio.

5. The image density control method as claimed in claim 4, wherein the cumulative sheet number for calculating the moving average of said image coverage ratio is variable.

6. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density; and providing a counter for calculating the image coverage ratio of the output image employed in the changing of said toner density control reference value, and a counter for calculating the image coverage ratio of the output image employed in the changing of the image forming conditions, the two counters being provided independently of each other.

7. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density; and changing said toner density control reference value in accordance with a toner density control reference correction table.

8. The image density control method as claimed in claim 7, wherein a maximum correction amount of said toner density control reference correction table is variable.

9. The image density control method as claimed in claim 8, provided for a plurality of development devices to which the image control method is applicable, which comprises setting said maximum correction amount independently for each of said plurality of development devices.

10. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner supply amount control device for keeping the toner density in said developer constant and a mechanism for determining a toner density control reference value to keep the development capability constant, and changes said toner density control reference value in accordance with an image coverage ratio of an output image, the method comprising:

changing image forming conditions in accordance with the image coverage ratio of the output image to produce a constant image density;

controlling said toner density control reference value to lower the toner density when the toner replacement amount in the developer in a fixed time period is larger than a predetermined reference value, and increasing the toner density when the toner replacement amount in the developer in a fixed time period is less than the predetermined reference value.

11. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner density detector, a toner supply amount control device for keeping the toner density in said developer constant and a mechanism for determining a toner density control reference value to keep the development capability constant, to change said toner density control reference value in accordance with the image coverage ratio of an output image and to determine an execution interval for changing image forming conditions in accordance with an image coverage ratio of the output image, the method comprising:

updating the toner density control reference value using a detected value of said toner density detector as a reference; and changing said detected value used as a reference in accordance with timing of the change of said image forming conditions.

12. The image density control method as claimed in claim 11, further comprising changing said detected value used as a reference when the printing is completed or when continuous printing is interrupted for changing of the image forming conditions.

13. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner density detector, a toner supply amount control device for keeping the toner density in said developer constant and a mechanism for determining a toner density control reference value to keep the development capability constant, to change said toner density control reference value in accordance with the image coverage ratio of an output image and to determine an execution interval for changing image forming conditions in accordance with an image coverage ratio of the output image, the method comprising:

updating the toner density control reference value using a detected value of said toner density detector as a reference; and updating the toner density control reference value when the image coverage ratio of said output image is smaller than a predetermined value, using, as a reference, the detected value of said toner density detector acquired when the image forming conditions are changed.

14. An image density control method which, when a two-component developer comprising a toner and a magnetic carrier on which the toner is held is carried on a developer carrier arranged opposing an image carrier, and said toner is used to develop an electrostatic latent image formed on the surface of the image carrier in a development region formed between said developer carrier and image carrier, employs a toner density detector, a toner supply amount control device for keeping the toner density in said developer constant and a mechanism for determining a toner density control reference value to keep the development capability constant, to change said toner density control reference value in accordance with the image coverage ratio of an output image and to determine an execution interval for changing image forming conditions in accordance with the image coverage ratio of the output image, the method comprising:

updating the toner density control reference value using a detected value of said toner density detector as a reference; and updating the toner density control reference value when the image coverage ratio of said output image is larger than a predetermined value, using, as a reference, the detected value of said toner density detector acquired when a directly preceding printing is performed.

* * * * *